US005585826A

United States Patent [19]

Schroeder et al.

[11] Patent Number: 5,585,826

[45] Date of Patent: Dec. 17, 1996

[54] SERVICE STATION FOR SIMULTANEOUS CAPPING/WIPING OF MULTIPLE INKJET CARTRIDGES HAVING DIFFERENT INKS

[75] Inventors: Christopher K. Schroeder, Napa; Kevin L. Glassett, Escondido, both of Calif.

[73] Assignee: Hewlett-Packard Company, Palo Alto, Calif.

[21] Appl. No.: 55,625

[22] Filed: Apr. 30, 1993

[51] Int. Cl.[6] ..... B41J 2/165

[52] U.S. Cl. ..... 347/29; 347/32; 347/33

[58] Field of Search ..... 346/140 R, 1.1; 347/29, 32, 33

[56] References Cited

U.S. PATENT DOCUMENTS 5,103,244 4/1992 Gast et al. ..... 346/140 R X

FOREIGN PATENT DOCUMENTS 2-202452 8/1990 Japan ..... 347/24
3-032848 2/1991 Japan ..... 347/33
4307257 10/1992 Japan ..... 347/33

*Primary Examiner*—Benjamin R. Fuller
*Assistant Examiner*—David Yockey
*Attorney, Agent, or Firm*—David S. Romney

[57] ABSTRACT

Multiple ink cartridges each having different inks are moved on a carriage through a service station where printheads are respectively simultaneously wiped and respectively simultaneously capped, with each printhead having its own wiper and capper, and where capping of the printheads cannot be done without first wiping the printheads. Both the wiping and capping functions are actuated by movement of the carriage.

6 Claims, 9 Drawing Sheets

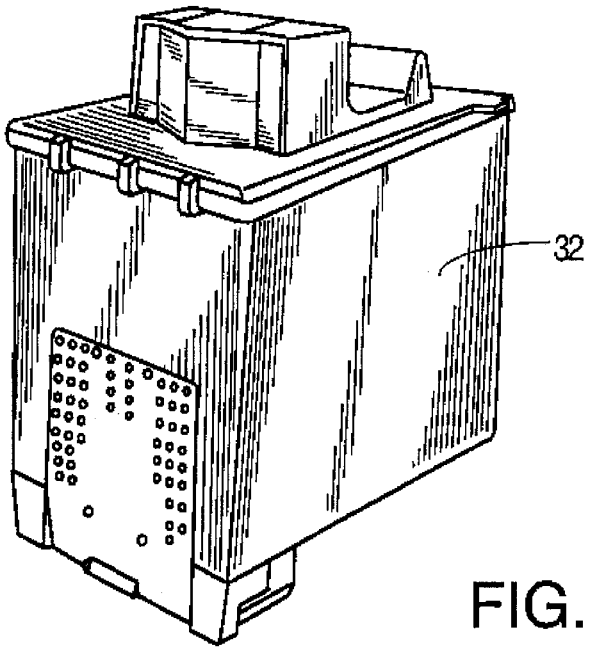
FIG. 3
FIG. 4
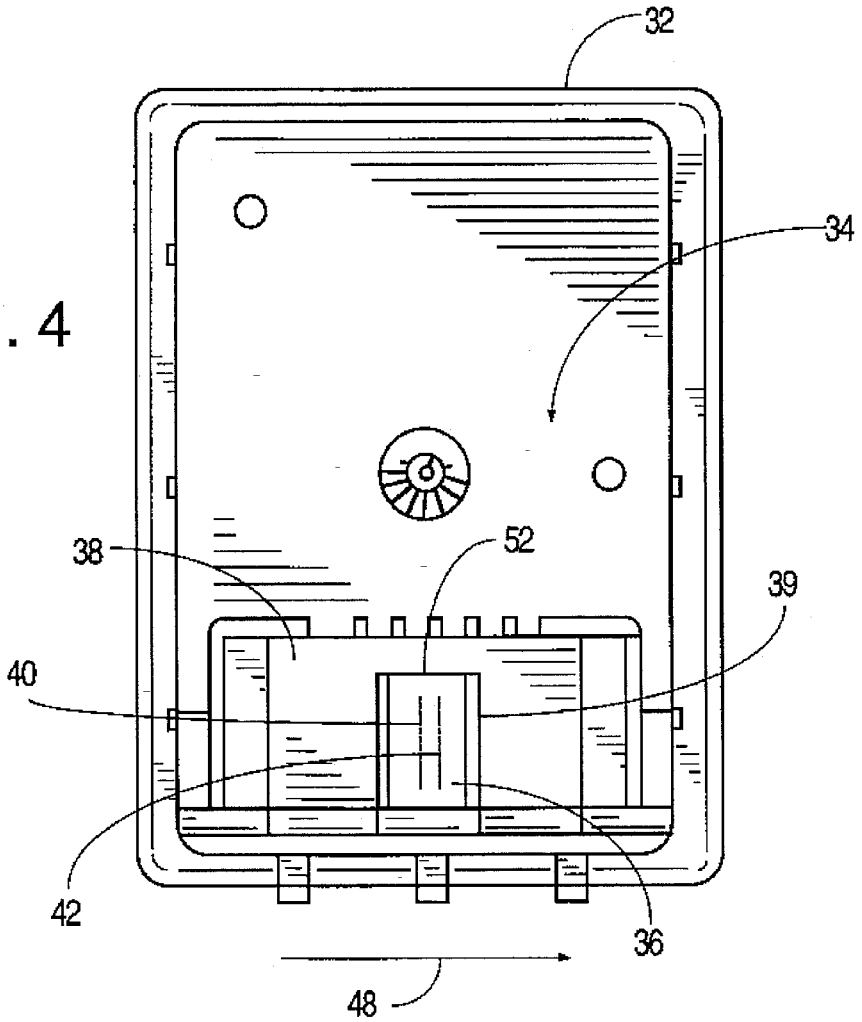

2X SCALE

SERVICE STATION FOR SIMULTANEOUS CAPPING/WIPING OF MULTIPLE INKJET CARTRIDGES HAVING DIFFERENT INKS

RELATED APPLICATIONS

This application is related to copending applications of Heinz Waschhauser entitled SERVICE STATION FOR INKJET PRINTER HAVING REDUCED NOISE, INCREASED EASE OF ASSEMBLY AND VARIABLE WIPING CAPABILITY, and application Ser. No. 07/949,197 of Wm Osborne filed Sep. 21, 1992, both of which are assigned to the assignee of the present invention.

BACKGROUND OF THE INVENTION

This application relates generally to inkjet printing, and more particularly to online service station functions of wiping and capping inkjet cartridges mounted in a print carriage.

Some prior color inkjet pen cartridges such as those used in the multi-cartridge Hewlett-Packard Paintjet and PaintJetXL printers functioned satisfactorily with no wiping and minimal capping. Other prior monochrome/color inkjet cartridges used in single cartridge Hewlett-Packard DeskJet printers were wiped and capped with relatively simple mechanisms of the type shown in U.S. Pat. No. 4,583,717. Complex problems arose when trying to service multiple ink cartridges having different color inks mounted together in a print carriage.

BRIEF SUMMARY OF THE INVENTION

Accordingly, it is an object of the present invention to provide a method and apparatus for having a carriage-actuated service station which has a separate wiper and capper respectively associated with each different ink cartridge mounted in a carriage.

IN THE DRAWINGS

FIG. 3 shows an exemplary inkjet cartridge for mounting in the printer carriage of FIG. 2;

FIG. 4 is an enlarged plan view of the printhead of the inkjet cartridge of FIG. 3;

DETAILED DESCRIPTION OF PREFERRED EMBODIMENT

Figures 1, 2:
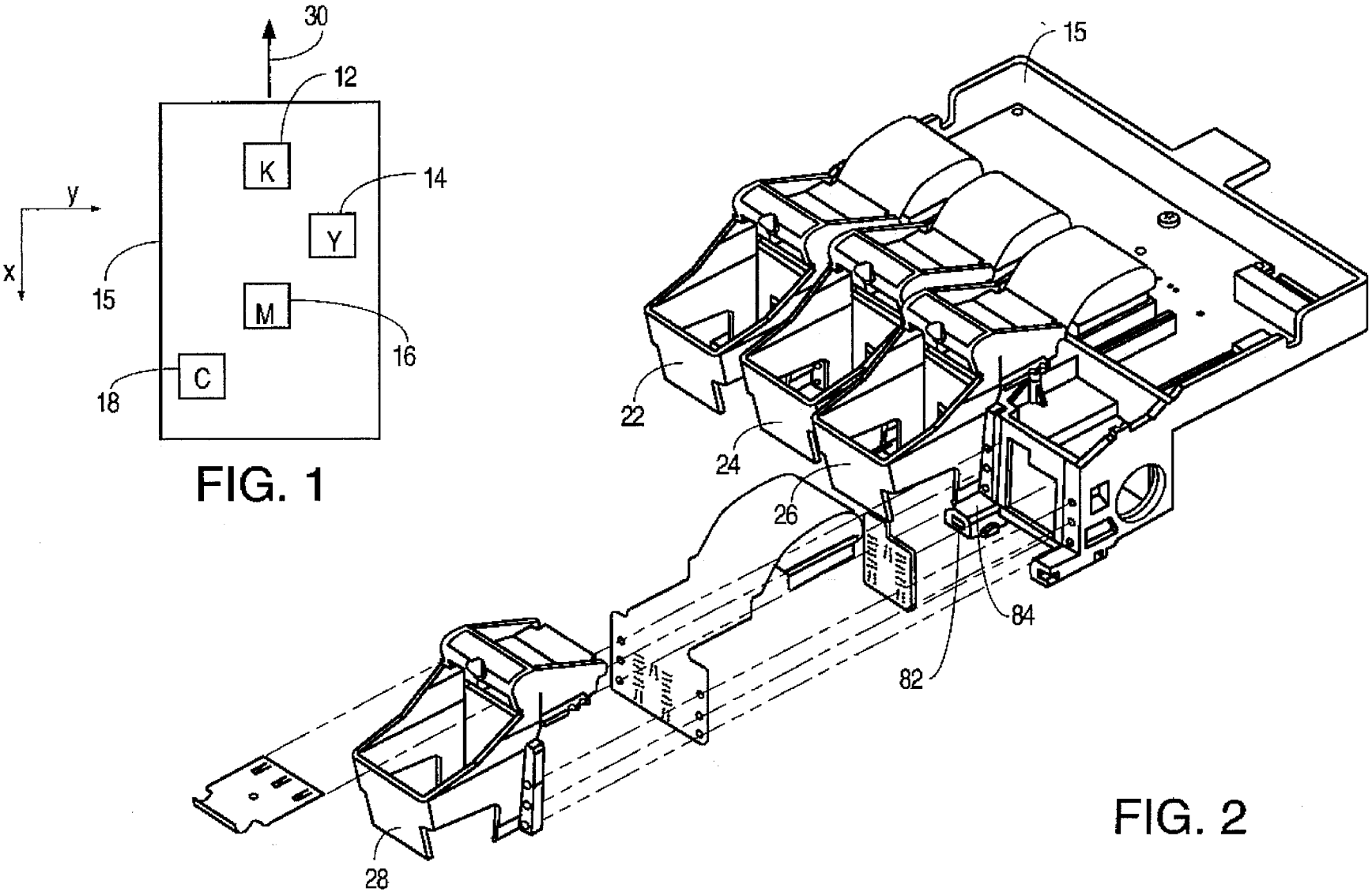
FIG. 1 is a schematic top view of a printer carriage showing the position relationships of four different color inkjet cartridges mounted on the carriage.
FIG. 2 is a partially exploded view of the printer carriage showing the actual chutes for mounting four different color inkjet cartridges in the positions shown in FIG. 1.

Referring to FIGS. 1 and 2, one type of color graphics inkjet printer employs a separate cartridge for each color of ink. Thus, a carriage 15 is provided for removably mounting a black ink cartridge 12 in chute 22, a yellow ink cartridge 14 in chute 24, a magenta ink cartridge 16 in chute 26, and a cyan ink cartridge 18 in chute 28. Cartridges may be staggered relative to each other as shown by comparing cartridges 14, 16, 18 or cartridges may be in direct alignment relative to a scan direction 30 as shown by comparing cartridges 12, 16. The invention provides a unique way for simultaneously servicing all of these cartridges at the same time, regardless of the staggered or aligned relationship with each other, as described in more detail below.

While not limited to a particular type of ink cartridge, the illustrated embodiment of the invention is used with the ink cartridge 32 of FIGS. 3–4 having a printhead 34 as best shown in FIG. 4, with outer lip 52, is mounted on a headland portion 38 by an adhesive bead 39 or the like which may extend around the periphery of the nozzle plate, with an orifice pattern such as parallel rows 40, 42 in a central portion of the nozzle plate.

Figure 5C:
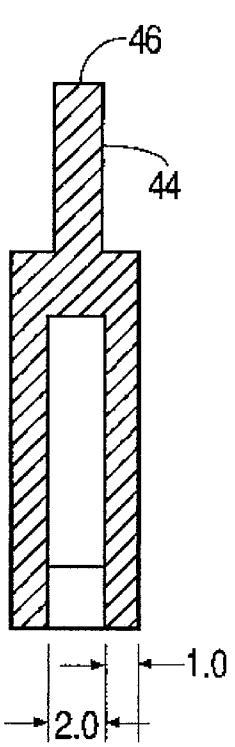
FIGS. 5A shows a top view and FIGS. 5B and 5C show sectional views of a wiper used for wiping the printhead of FIG. 4.
Figure 5B:
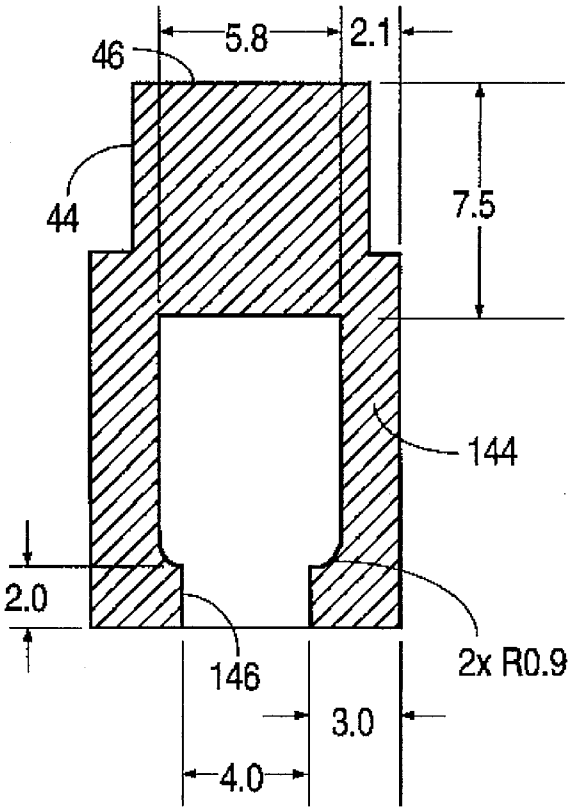
Figure 5A:
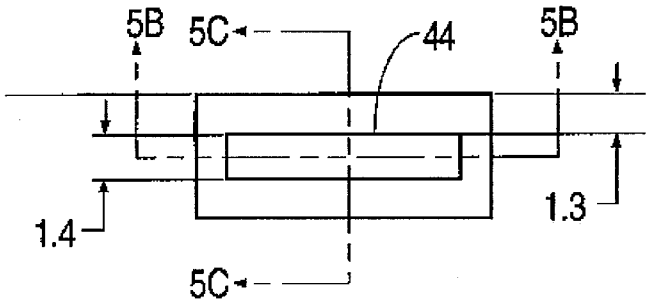
Figure 6A:
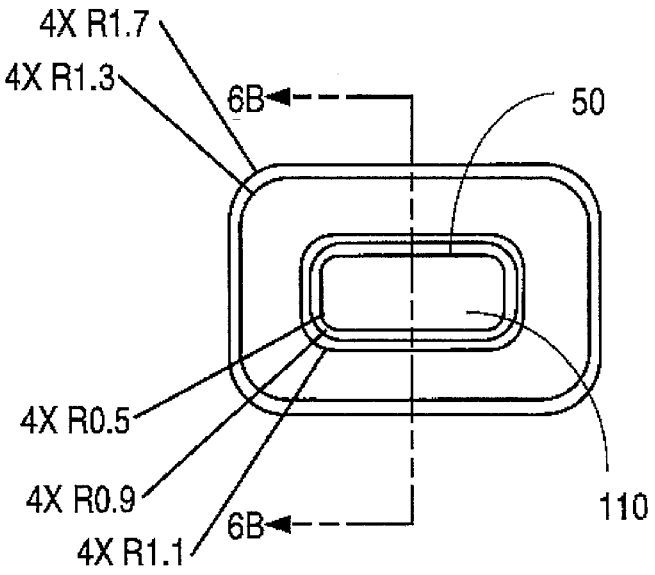
FIGS. 6A shows a top view and FIG. 6B shows a sectional view taken along the line B—B of a capper for capping the printhead of FIG. 4.
Figure 6B:
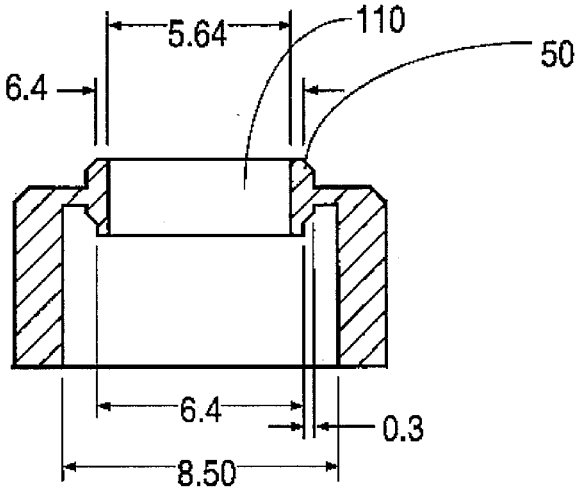

Wiping is accomplished by a wiper as shown in FIGS. 5A–5C having a narrow blade portion 44 with a top edge 46 for rubbing across the nozzle plate preferably in only one direction as shown by arrow 48 (see FIG. 4). Capping is accomplished by a capper as shown in FIGS. 6A–6B having perimeter lips 50 for completely surrounding the orifice pattern without overlapping any outer edge 52 of the nozzle plate or the adhesive bead 39. The dimensions of a preferred embodiment of a wiper and capper are indicated on the drawings.

Figure 7:
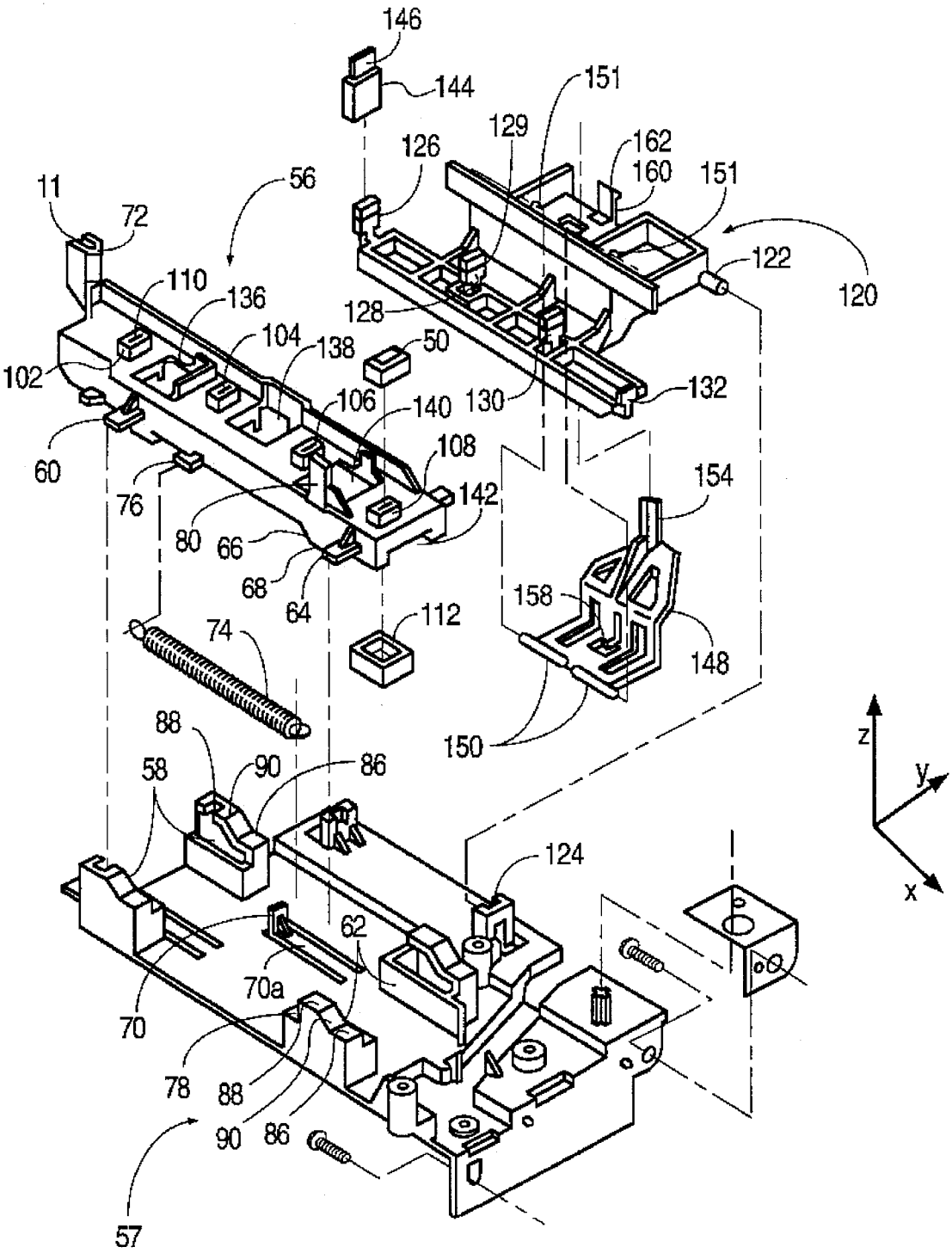
FIG. 7 is an exploded view of a presently preferred embodiment of a service station for using the wiper of FIGS. 5A–5C and the capper of FIGS. 6A–6B on the printhead of FIG. 4.
Figure 11:
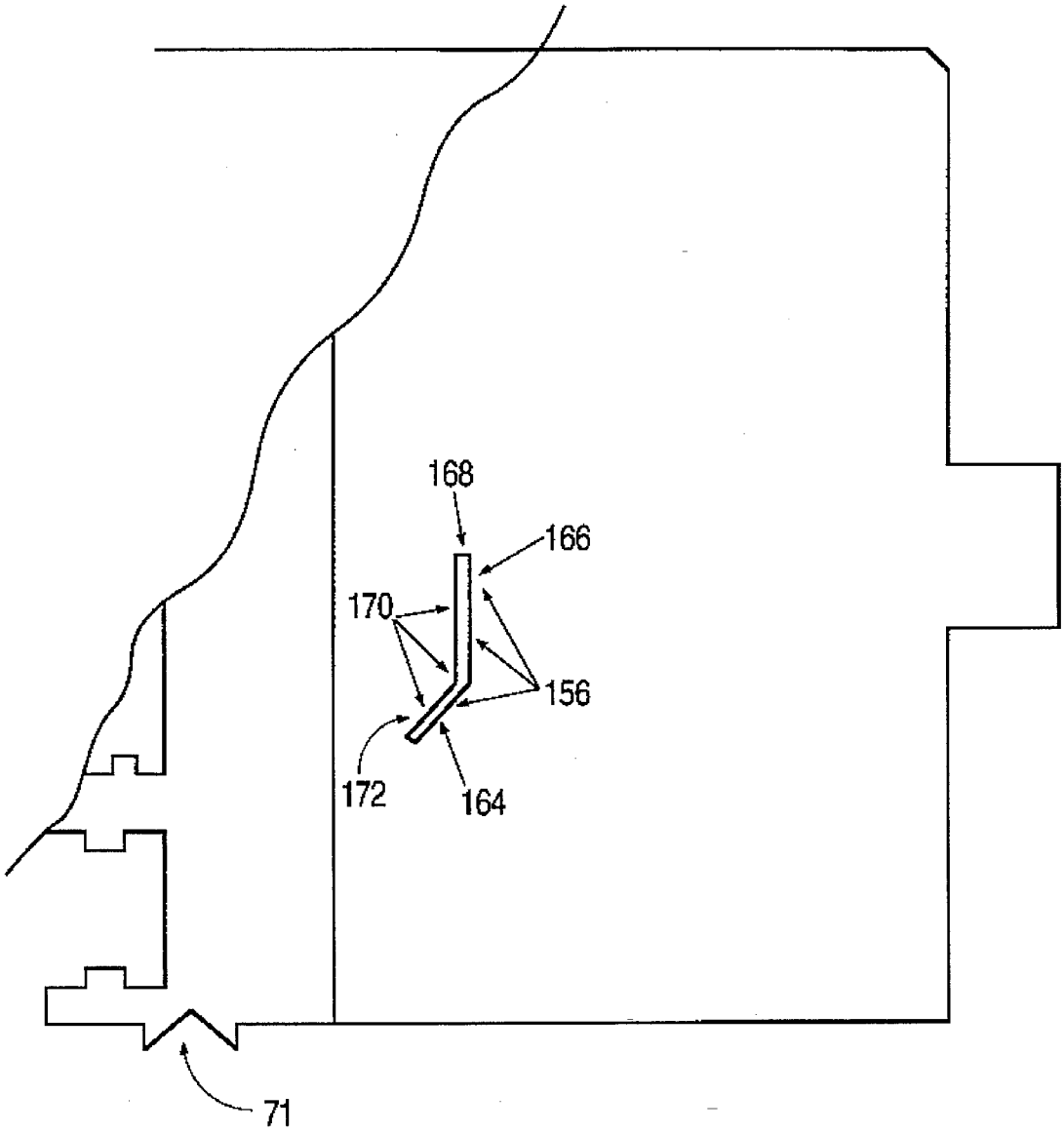
FIG. 11 is a fragmentary bottom view of the printer carriage.

The exploded drawing of FIG. 7 shows the unique construction of the service station. In that regard, a base 54 is fixedly attached to a printer frame (not shown) for slidably mounting a sled 56 in slots 58 by sled tabs 60 and in slots 62 by sled tabs 64. Sloped cam ledges 66 and horizontal cam ledges 68 on the sled ride along matching pillars 70 on the base to raise the sled from a normally low uncapped position to a high capped position as the sled is pulled laterally of the moving carriage's engagement by carriage notch 71 on the carriage (see FIG. 11) with catch arm 72 on the sled. The pillars are mounted on one end of a plastic arm 70*a* which can flex downwardly in order to provide positive engagement of the sled to the carriage.

A spring 74 connects between a sled hook 76 and a base hook 78 in one of the slots 62. By making such hooks 76, 78 off-axis to each other relative to the scan direction of the carriage, the spring 74 provides both lateral and rotational components of pull in order to hold the sled in proper alignment in the high capped position with guidepost 80 engaged with an end 82 of carriage datum bar 84, (see FIG. 2) and also to return the sled to its normally low uncapped position as the carriage leaves the service station. The slots have a lower portion 86 and upper 88 portion to facilitate movement of the sled in its aforesaid low and high positions, with a connecting portion 90 which matches the length and angle of the sloped cam ledge 66.

Figure 8:
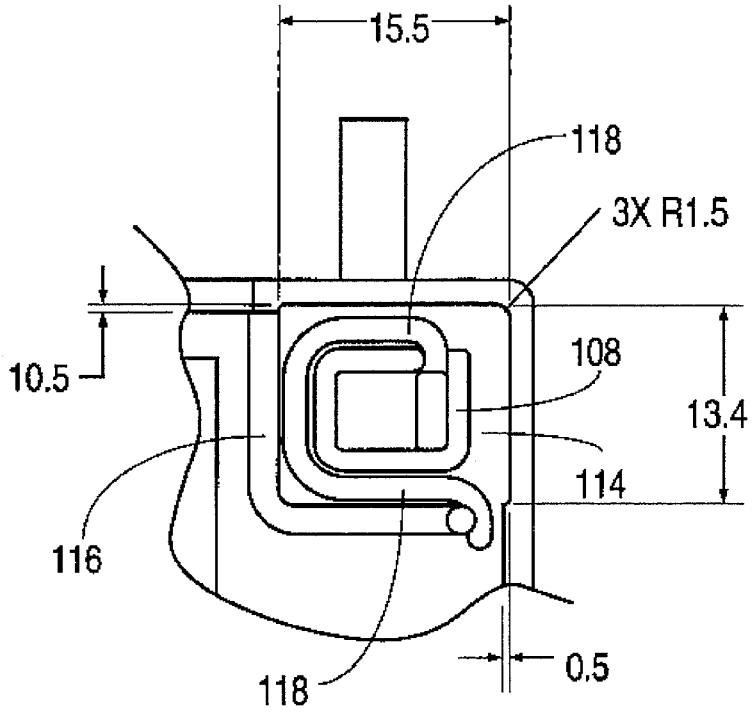
FIG. 8 is a fragmentary bottom view showing a shoe mounting seat and venting passage on a service station sled.
Figure 9:
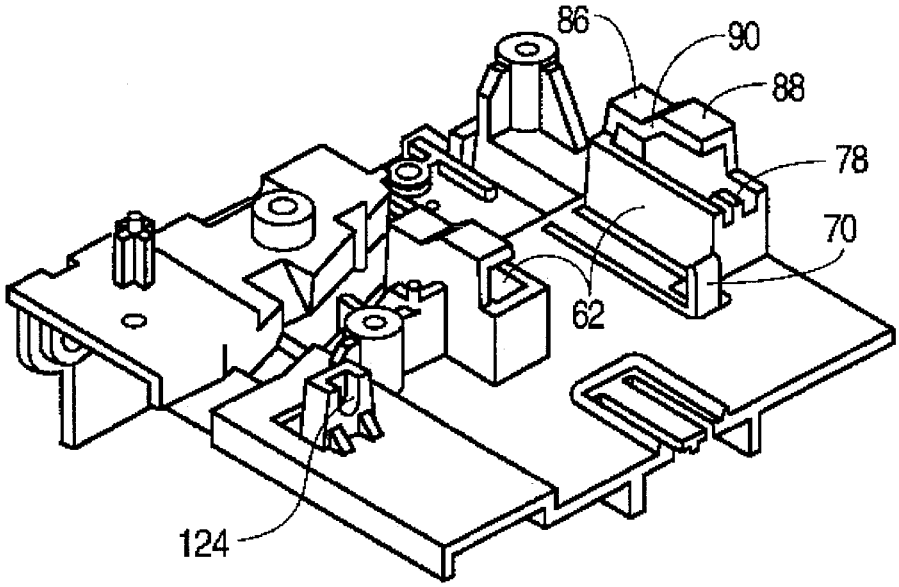
FIG. 9 is a fragmentary perspective view of the top of a service station base.
Figure 10:
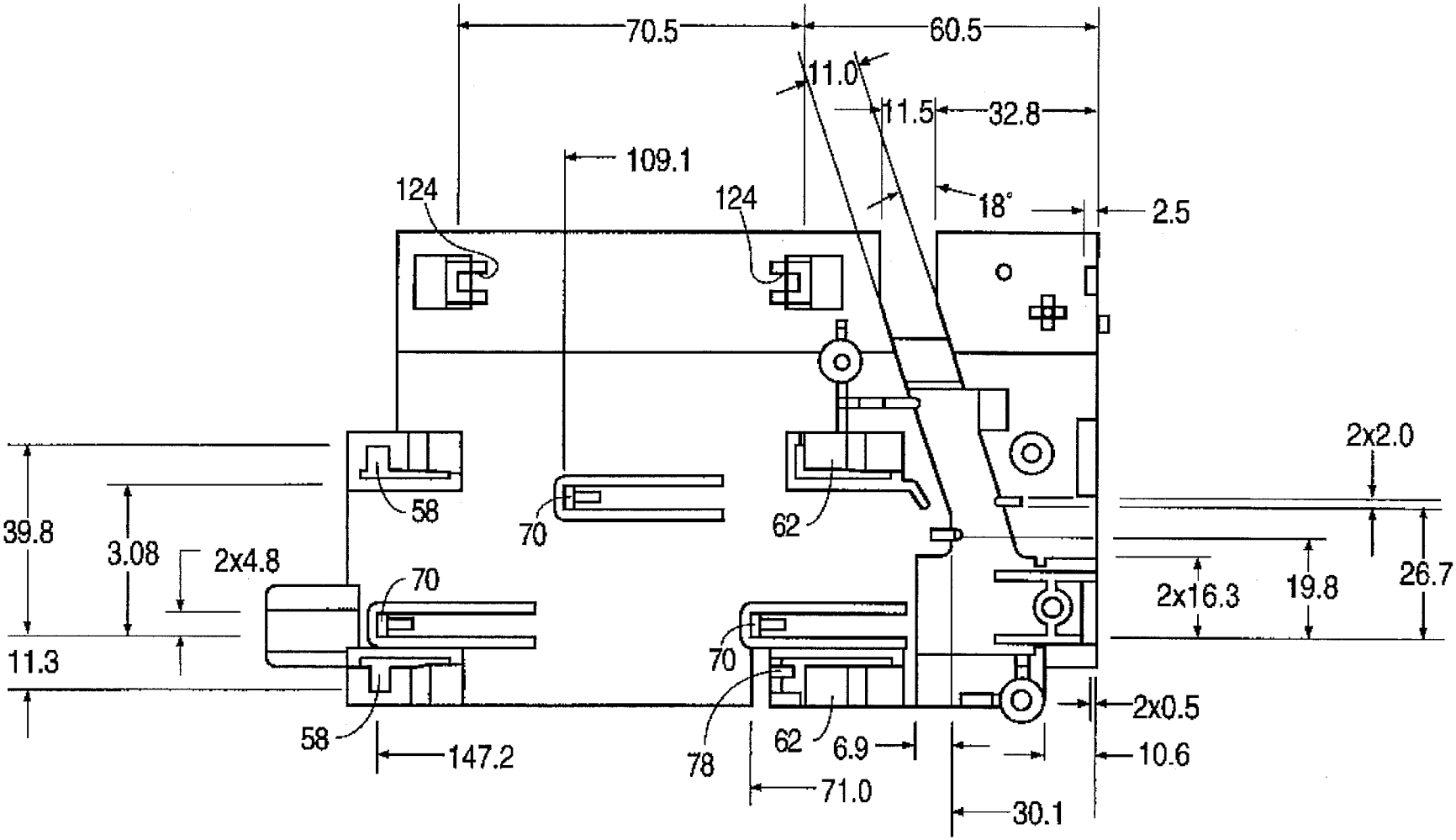
FIG. 10 is a top view of the service station base of FIG. 9.

There are four capper channels 102,104, 106, 108 which extend above and below the sled and are positioned by measurements along X and Y axes to exactly correspond to the positions of the four cartridges shown in FIG. 1. A capper as shown in FIGS. 6A–6B is mounted over the upper end of each channel providing an air-tight fit on the top of sled 56, except for a central passage 110 defined by perimeter lips 50. A shoe 112 is mounted over the lower end of each channel into a seat 114 (see FIG. 8) defined by a peripheral ridge 116, providing an air-tight fit on the bottom of sled 56, except for a small-diameter vent passage 118 which passes along three sides of the channel before exiting to the outside air. Such venting minimizes any drying out of the ink orifices on the nozzle plate after the four cappers simultaneously engage their respective printheads and minimize any undesirable pressure buildup on the nozzles 40, 42 that might otherwise occur.

A wipe rack 120 operates independently of the sled and is pivotally mounted through pins 122 in journal slots 124 on the base for pivotal movement up and down to move a series of four wiper mounts 126, 128, 130, 132 which fit in a series of matching spaced apertures 136, 138,140 and end space 142 in the sled. Like the channels on the sled, the wiper mounts on the wipe rack are positioned along the X and Y axes to exactly correspond to the positions of the printheads mounted in the carriage. The wiper blades have an enlarged diameter sleeve 144 which terminates in a narrow diameter neck 146 (see FIG. 5*b*) to securely hold each wiper blade on its respective mount. A wiper lever 148 is loosely attached by pivot pins 150 to the wipe rack at 151 to move the wiper mounts and their respective wipers from a normally lowered position into an upper wiping position by the lever acting against wall 152 when an upper cam follower 154 follows a cam surface 156 on the underside of the carriage (See FIG. 11). A central aperture 158 in the wiper lever 148 is sized to slidably fit over a post 160 with an upper boss 162 which acts as a stop to prevent excessive upward pivotal movement of the wipe lever. The weight of the wipe rack itself brings it pivotally back to lowered default position with the wipers below the level of the nozzle plates.

Figure 12:
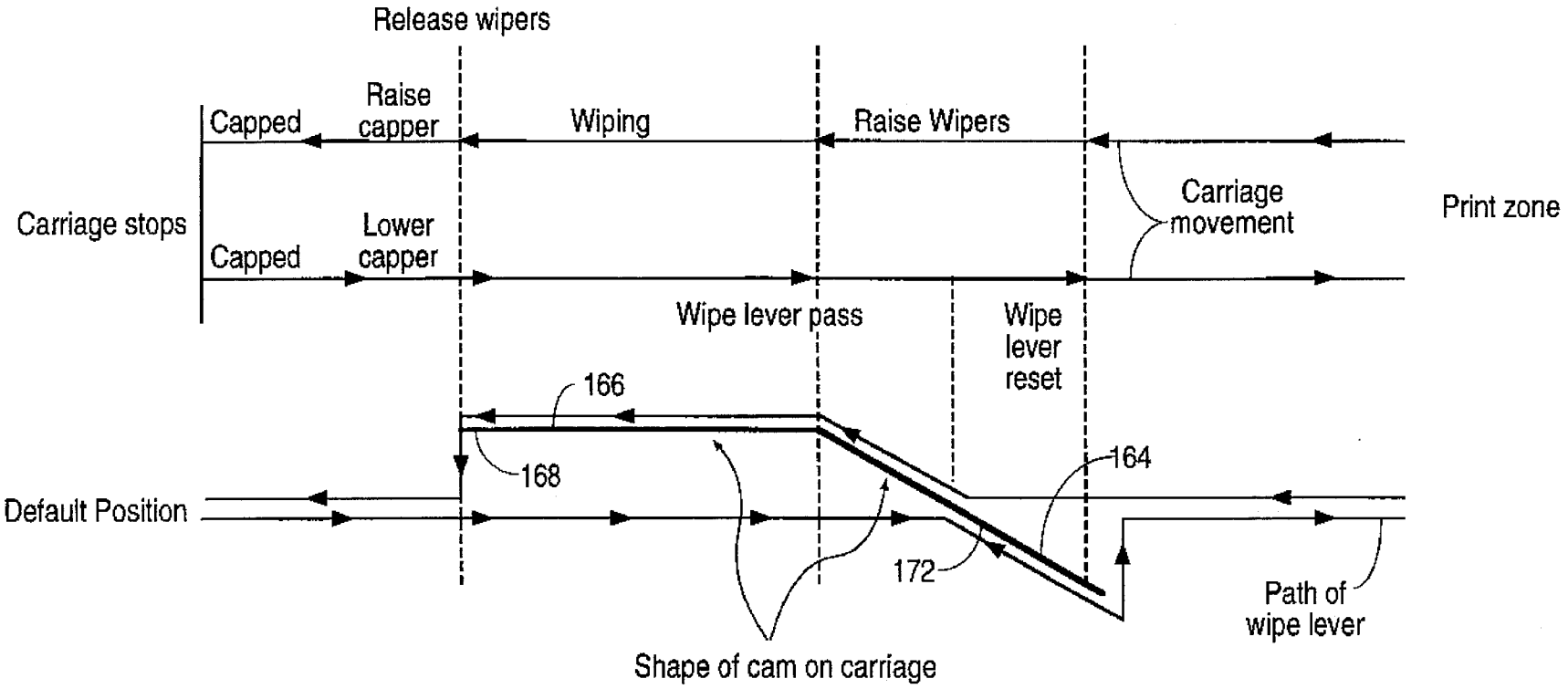
FIG. 12 is a schematic timing diagram showing the relationship of the carriage movement with the wiping and capping functions of the service station.

The actual sequence of steps that occur during the wiping and capping operation is shown in FIG. 12. The sloping portion 164 of the cam surface causes all the wipers to be raised into wiping position for their respective nozzle plates, while the straight portion 166 (i.e., the portion parallel to the carriage scan direction) holds all the wipers in wiping position until the cam follower reaches the terminus 168. The opposite cam surface 170 has a reverse sloping portion 172 which brings the wiper lever back into position for re-engagement with the first cam surface 156 when the carriage makes a return trip to the service station. It is to be noted that all wiping is in the same direction, which is believed to provide better results than bi-directional wiping, and that the same wiper always wipes the same nozzles, thereby avoiding any intermixing of inks on the nozzle plates. Also, it is not possible to put the cappers in position without first wiping all of the nozzle plates.

Referring now to FIG. 12, which is deemed to be self-explanatory, the operation is as follows: As the carriage moves into the service station, the wipe lever engages the cam on the carriage thereby raising the wipers. As the carriage continues its traverse, all of the nozzle plates are simultaneously wiped. When wiping is completed, the wipe lever passes beyond the cam and the wipers are released (i.e., lowered). As the carriage continues its traverse, the sled is engaged by the carriage and simultaneous capping occurs after the cappers are gradually raised into capping position prior to the carriage reaching it final stop position, which in this embodiment is against the printer case. When the carriage goes in reverse direction to leave the service station, the cappers are gradually lowered to remain in default position clear of the nozzle plates. As the carriage continues in reverse direction, the wiper lever passes on the back side of the cam such that the wipers remain in default position well below the nozzle plates.

While an exemplary embodiment of the invention has been shown and described, it will be understood by those skilled in the art that various changes, modifications and enhancements can be made without departing from the spirit and scope of the invention as defined by the following claims.

We claim:

1. Apparatus for servicing a plurality of ink printheads mounted at positions on a carriage movable in two directions, comprising:

stationary base member;

a plurality of wiper blades for wiping the plurality of ink printheads;

a wipe rack pivotably mounted on said base member;

a series of wiper blade mounts on said wipe rack, each of said plurality of wiper blades being mounted on a wiper blade mount and being linearly spaced and fixed in position to exactly correspond to the positions of the plurality of printheads;

a wiper lever pivotably mounted to said wipe rack for moving said wiper blades and said wiper blade mounts into a wiping position;

a cam follower on said wiper lever, each one of said wiper blades being associated with a predetermined one of the plurality of ink printheads;

a sled movably mounted on said base member, said sled having a series of spaced apertures;

a plurality of cappers mounted on said sled each one of said cappers being associated with a predetermined one of the plurality of ink printheads, wherein said plurality of cappers are interleaved with said plurality of wipers and wherein any two of said plurality of cappers are separated by at least one of said plurality of wipers;

a cam surface on the carriage engaging said wiper lever in one of said directions and for moving all of said plurality of wiper blades through said sled apertures simultaneously to a position interleaved with said plurality of cappers and into wiping engagement with the plurality of ink printheads, with each one of said wiper blades wiping simultaneously only a predetermined one of the plurality of ink printheads; and capper actuating means on said carriage for moving said plurality of cappers into capping engagement with the plurality of printheads, with each of said plurality of cappers capping only the predetermined one of the plurality of ink printheads.

2. The apparatus of claim 1 wherein said wiper blades and said cappers are aligned such that the wiping by said wiper blades occurs prior to the capping caused by operation of said cappers.

3. The apparatus of claim 1 wherein said cam surface engages said wiper lever in another of said directions for moving all of said plurality of wiper blades to achieve only one-way wiping.

4. A method of servicing a plurality of ink cartridges mounted on a carriage, each of the plurality of ink cartridges having different color ink and each of the plurality of ink cartridges carrying one of a plurality of printheads, including the steps of:

providing a service station including a wipe rack having a plurality of wiper blades, and a sled having a plurality of cappers and apertures between the cappers, the plurality of wiper blades being adapted to be interleaved with the plurality of cappers in a wiping active position;

moving the plurality of cartridges laterally in a direction from a first position where all of the plurality of wiper blades are in a wiper passive position to a second position where all of the plurality of wiper blades pass through the sled apertures and are in a wiper active position interleaved with said plurality of cappers, with each one of the plurality of wipers in contact with a respective one of said plurality of printheads on the plurality of ink cartridges;

then moving the plurality of cartridges in said direction from said second position to a third position where all of a plurality of cappers are in a capper passive position, wherein said moving of the plurality of cartridges from said second position to said third position causes each one of the plurality of wiper blades to simultaneously wipe a respective one of the plurality of printheads;

then moving the plurality of cartridges in said direction from said third position to a fourth position where said plurality of cappers are in a capper active position with each one of said plurality of cappers in contact with a respective one of the plurality of printheads on the plurality of ink cartridges;

then moving the plurality of ink cartridges in said direction to a fifth position causing each one of said plurality of cappers to simultaneously cap the respective one of the plurality of printheads; and then maintaining the plurality of ink cartridges in said fifth position, said maintaining step occurring after each of said plurality of wiper blades have simultaneously wiped one of the plurality of printheads and wherein the wiping by said plurality of wipers is solely in one direction.

5. The method of claim 4 wherein the carriage includes a camming surface and said method further including the step of changing said plurality of wipers from said wiper passive position to said wiper active position by movement of said plurality of wipers along said camming surface.

6. Apparatus for servicing a plurality of spaced ink printheads mounted on a movable carriage comprising:

a stationary base member;

a wipe rack pivotally mounted to said base member;

a series of spaced wiper mounts on said wipe rack;

a plurality of wiper blades, each of said wiper blades being on one of said wiper mounts, for wiping a predetermined one of the plurality of spaced ink printheads and spaced to correspond with the spacing of the plurality of spaced ink printheads;

a sled movably mounted on said base member, said sled including a series of spaced apertures;

a plurality of cappers mounted on said sled in fixed positions interleaved with said apertures, the cappers being associated with a predetermined one of the plurality of spaced ink printheads;

a cam surface on the movable carriage and a cam follower on said wipe rack engaging with said cam surface, such that movement of the movable carriage moves said wiper blades through said sled apertures to a position where said wiper blades are interleaved with said cappers and in position to wipe the predetermined one of the plurality of spaced ink printheads; and capper actuating means on the carriage for moving said sled, such that said cappers are moved into capping engagement with respective ones of the plurality of spaced ink printheads.

* * * * *